US005317844A

United States Patent [19]

Legler

[11] Patent Number: 5,317,844

[45] Date of Patent: Jun. 7, 1994

[54] UNIVERSAL POLE ANCHORING DEVICE

[75] Inventor: Steve Legler, Westmount, Canada

[73] Assignee: Tri-Steel Industries Inc., Montreal, Canada

[21] Appl. No.: 949,152

[22] Filed: Sep. 23, 1992

[30] Foreign Application Priority Data

Jun. 9, 1992 [CA] Canada ..... 2070885

[51] Int. Cl.[5] ..... E02D 5/74

[52] U.S. Cl. ..... 52/155; 52/165; 52/152

[58] Field of Search ..... 52/152, 155, 165

[56] References Cited

U.S. PATENT DOCUMENTS

| | | | |
|---|---|---|---|
| 645,372 | 3/1900 | Paldi | 52/155 |
| 658,779 | 10/1900 | Huntress | 52/152 |
| 3,514,911 | 6/1970 | Preradovich | 52/165 |
| 4,218,858 | 8/1980 | Legler | 52/165 |
| 4,248,025 | 2/1981 | Kleine et al. . | |
| 5,060,435 | 10/1991 | Bogdanow | 52/165 |

*Primary Examiner*—Carl D. Friedman

*Assistant Examiner*—Christopher Todd Kent

*Attorney, Agent, or Firm*—Burns, Doane, Swecker & Mathis

[57] ABSTRACT

A universal pole anchoring device for supporting utility poles vertically over a hard surface such as rock, concrete or the like is disclosed. The device comprises a harness assembly connected about a base section of a pole to be supported on the hard surface. The harness is secured by bolts all about the base section. The harness assembly is comprised of harness members each defined by an anchor bolt attachment pipe having a pair of pole engaging clamps connected thereto in spaced alignment. The clamps support the attachment pipe spaced from and at an outwardly depending angle when the harness is secured to a pole. The harness assembly also has a predetermined number of harness numbers interconnected by the connecting bolts about the base section and dependent on the diameter of the pole. An anchor bolt assembly is connectible to each of the attachment pipes of the harness members to anchor the harness assembly in the hard surface to support the pole vertically thereover.

17 Claims, 2 Drawing Sheets

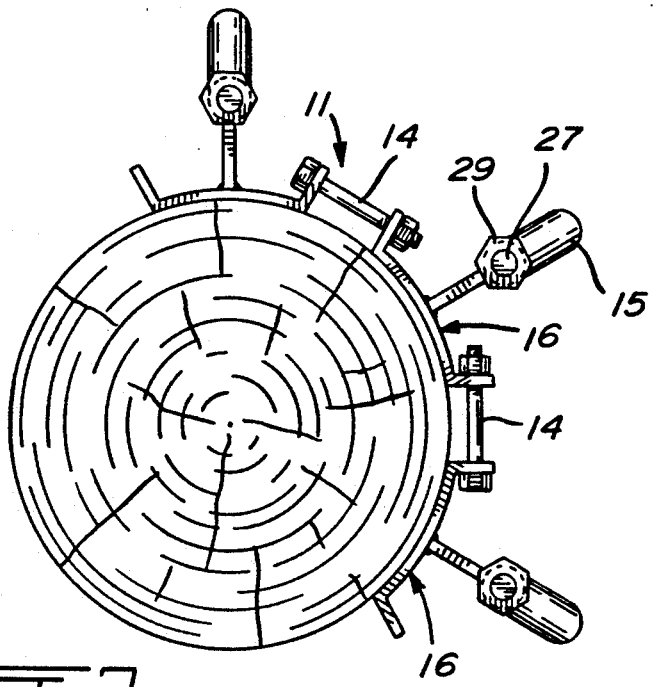
FIG. 2
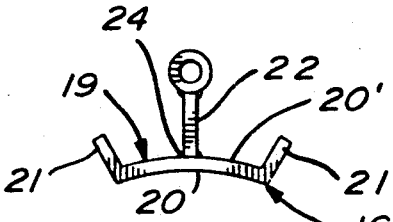
FIG. 3
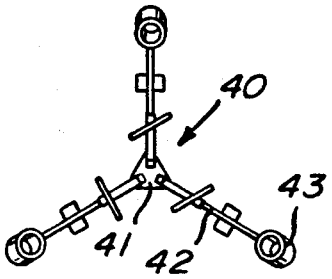
FIG. 4A
FIG. 4B
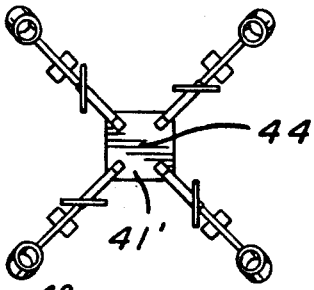
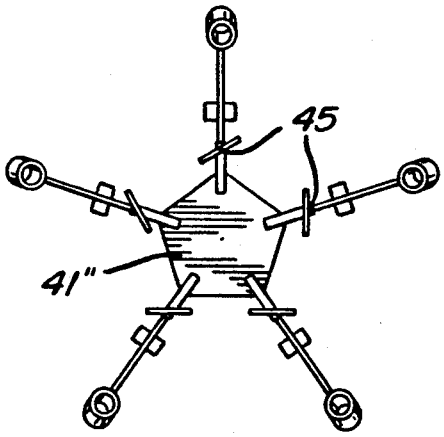
FIG. 4C
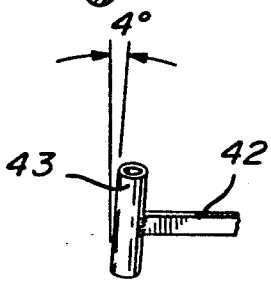
FIG. 5

UNIVERSAL POLE ANCHORING DEVICE

TECHNICAL FIELD

The present invention relates to a universal pole anchoring device for supporting utility poles, of different diameters, vertically over a hard surface, such as rock, concrete or the like, and wherein a plurality of such anchoring devices are interconnected in a harness assembly about a base section of a pole and with anchor bolts extending into the ground surface at an outward angle outwardly spaced from the pole to provide increased anchoring strength.

BACKGROUND OF INVENTION

In U.S. Pat. Nos. 4,218,858 and 4,248,025 there is described a pole anchoring system which is strapped about a lower portion of a wooden pole to support the pole vertically over a hard surface, such as rock, concrete or the like. These patents disclose various pole anchoring devices to attach to anchor bolts which are secured in bore holes drilled vertically within the ground surface about the pole. The anchor bolts are positioned quite closely to the pole to be secured to the anchoring devices which are attached to the pole. With these pole anchoring devices it has been necessary to provide harnesses of different sizes to fit wood poles of different diameters. Accordingly, it is necessary to carry large inventories of these anchoring devices including anchor bolt of different dimensions and lengths to adapt to poles of different sizes. Further, because the anchor bore holes are spaced close to the poles, it is necessary to anchor these bolts at a suitable depth to ensure proper anchoring.

SUMMARY OF INVENTION

It is a feature of the present invention to provide a universal pole anchoring device which substantially overcomes the above-mentioned disadvantages by providing a common harness member which may be used in an assembly of a certain number of these members to support poles of different diameters vertically over a hard ground surface.

Another feature of the present invention is to provide a universal pole anchoring device which is used in a harness assembly comprising a plurality of these anchoring devices and wherein the anchor bolts are supported spaced from a pole to be supported by the harness assembly and wherein the anchor bolts are disposed in a cone configuration about a base portion of the pole to provide increased anchoring strength in the ground against overturning forces and permitting the bore holes to be drilled shallower than the prior art.

Another feature of the present invention is to provide a universal pole anchoring device for use in a harness assembly comprising a plurality of these devices and wherein the anchor bolts are spaced from the pole making it easier to anchor the bolts in bore holes, and further wherein a substantial reduction in inventory is achievable as compared with similar prior art anchoring devices.

Another feature of the present invention is to provide a drilling template in association with the universal pole anchoring device to permit the boring of holes in the hard surface on which the pole is to be secured, and at a substantially precise angle so as to provide for a cone-shape anchoring system.

According to the above features, from a broad aspect, the present invention provides a universal pole anchoring device for supporting utility poles vertically over a hard surface, such as rock, concrete or the like. The device comprises a harness assembly connected about a base section of a pole to be supported on the hard surface. Connecting means is provided to immovably secure the harness assembly about the base section. The harness assembly is comprised of harness members each defined by an anchor bolt attachment means having a pair of pole engaging clamps connected thereto in spaced alignment. The clamp supports the attachment means spaced from and at an outwardly depending angle when the harness is secured to a pole. The harness assembly has a predetermined number of harness members interconnected by the connecting means about the base section depending on the diameter of the pole. An anchor bolt assembly is connectible to each of the anchor bolt attachment means of the harness members to anchor the harness assembly to the hard surface to support the pole vertically thereover.

According to a still further broad aspect of the present invention there is provided a universal pole anchoring device for use in a harness assembly connectible about a base section of a wooden utility pole to be supported vertically over a hard ground surface, such as rock, concrete or the like. The harness is connected to anchor bolts to secure same to the ground surface. The pole anchoring device comprises an anchor bolt attachment means having a pair of pole engaging clamps connected thereto in spaced alignment. The clamps when interconnected in a harness assembly to a pole supports the attachment means spaced from and at an outwardly dependent angle to the pole, so that anchor bolts connected thereto extend in the ground surface in a cone-shaped configuration about the pole.

According to a still further broad aspect of the present invention there is provided a universal pole anchoring device comprising a harness assembly connectable about a base section of a utility pole to be supported vertically over a hard ground surface, such as rock, concrete or the like. The harness assembly is connected to anchor bolts to secure the anchor bolts to the hard ground surface. The harness assembly has at least three anchor bolts receiving guide means, each having a bolt passage defined between a top end and a bottom end of the guide means. The harness assembly has pole engaging clamps connected thereto in spaced alignment. The clamps are adapted to be interconnected about the base section of the utility pole whereby the harness assembly surrounds the pole when connected thereto. The bolt receiving guide means is spaced from and at an outwardly dependent angle to the pole whereby the anchor bolts extend at an angle greater than 0 and less than 90 degrees with respect to the pole. The anchor bolts are connected to the guide means and extend through the bolt passages from the bottom end and into the hard ground surface in a cone-shaped configuration about the pole. Securing means is connected to a top end of the bolt which extends from the top end of the bolt passage to provide axial displacement and securement of the anchor bolts in hard ground.

BRIEF DESCRIPTION OF DRAWINGS

A preferred embodiment of the present invention will now be described with reference to the accompanying drawings in which:

FIG. 2 is a cross-section view showing the harness assembly secured about the pole;

FIG. 3 is a top view of a harness member utilized in the harness assembly;

FIGS. 4A to 4C are top view showing the construction of various drilling templates to bore anchor holes into a hard ground surface at an angle and dependent on the number of harness members utilized in an assembly which itself is dependent on pole diameter; and FIG. 5 is a perspective view of a drill bit guide tube utilized in the drilling template.

DESCRIPTION OF PREFERRED EMBODIMENTS

Figure 1:
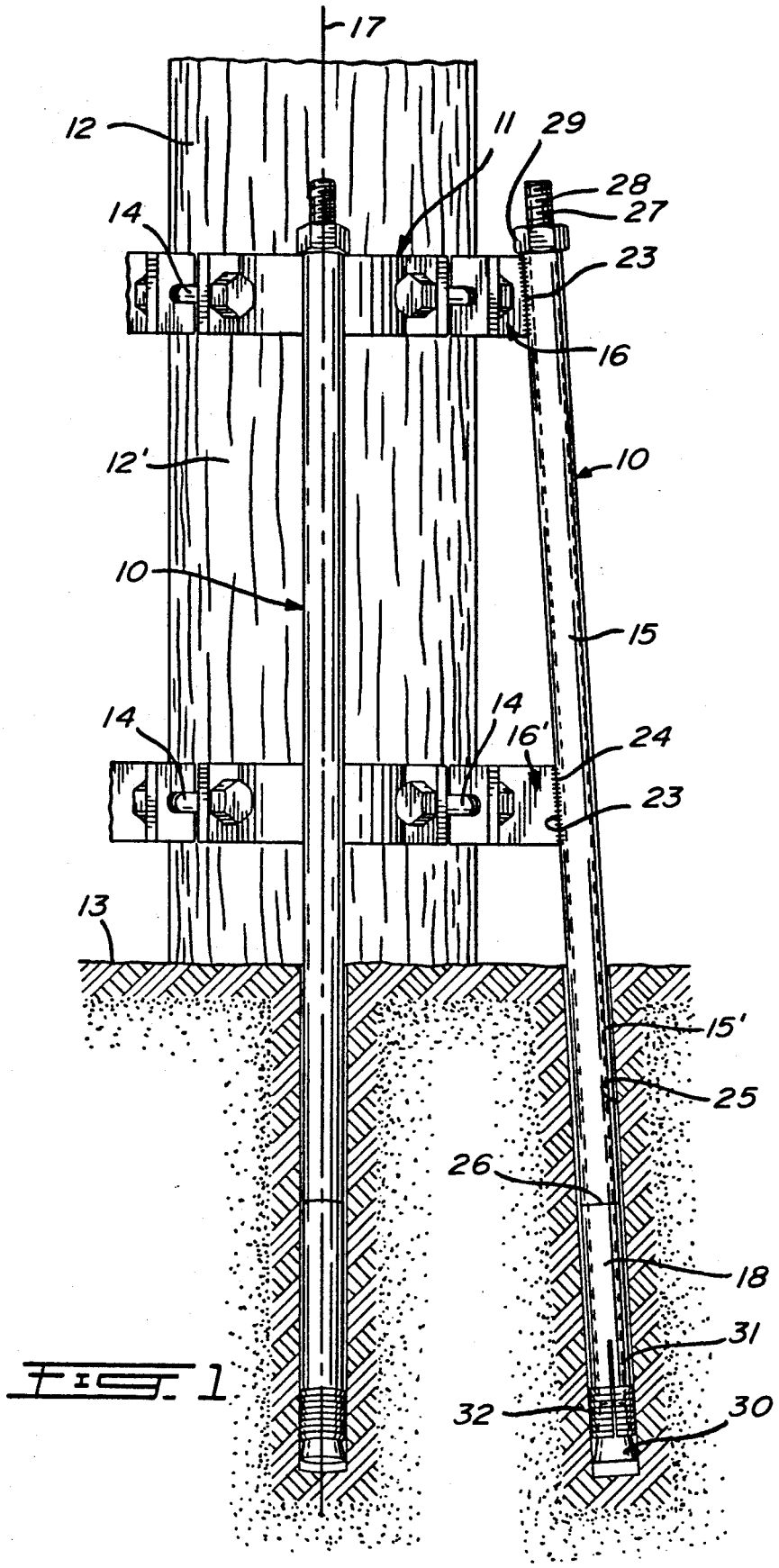
FIG. 1 is a partly fragmented side view showing the universal pole anchoring device interconnected in a harness assembly to support a wooden pole vertically over a hard surface.

Referring now to the drawings, and more particularly to FIGS. 1 to 3, there is shown generally at 10 the universal pole anchoring device of the present invention utilizes in a harness assembly 11 for supporting wooden utility poles 12 vertically over a hard surface 13, such as rock, concrete or the like. The pole anchoring device 10 is comprised in the harness assembly 11 and connected about the base section 12' of the pole 12 and interconnected together by connecting means such as connecting bolts 14 to immovably secure the harness assembly 11 about the base section 12'. The anchoring device 10 is of a universal size and only the number of these vary to support poles of different sizes.

Each anchoring device 10 is defined by an anchor bolt attachment pipe 15 having a pair of pole engaging clamps 16, 16' connected thereto in spaced alignment. The clamps 16, 16' support the attachment pipe 15 spaced from and at an outwardly depending angle of about 4° from the pole vertical axis 17 when the harness is secured to the base section 12' of the pole. The harness assembly has a predetermined number of anchoring devices which are interconnected by the bolts 14 and dependent on the diameter of the poles to be supported. An anchor bolt assembly 18 is connected to the anchor bolt connecting pipe 15 of each anchoring device 10 to anchor the harness assembly 11 in the hard surface 13 to support the pole vertically thereover.

As shown more clearly in FIG. 3, the clamps 16, 16' are comprised of elongated metal plates 19 which are galvanized and are shaped to define a curved wall section 20 with opposed connecting flanges 21 which are outwardly disposed. A connecting spacer 32 is secured to an outer surface 20' of the curved wall section 20 and substantially at mid-length thereof and transversely thereto. The connecting spacer 22 is also a metal plate having an outer sloped connecting edge 23 (see FIG. 1) which is secured to the connecting pipe 15 and which extends at an angle of approximately 4°. This connecting edge is welded, such as at 24, to the pipe 15.

The clamps are connected in alignment and spaced apart with the upper clamp 16 connected to a top end region of the connecting pipe 15, and the second clamp connected spaced below the first clamp a predetermined distance to provide proper bracing of the pole. The lower extension section 15' of the anchor bolt connecting pipe 15 is also of a predetermined length and extends into the bore hole 25 which is bored in the hard surface 13 to position the isolation joint 26 of the anchor bolt assembly 18 within the bore hole.

The anchor bolt assembly 18 consists of anchor bolt 27 having a top threaded end 28 and a securing nut 29 threadably engaged therewith to provide axial displacement of the anchor bolt 27 to secure same in the bore hole. The anchor bolt has a conical bottom end 30 with a lower split sleeve section 31 positioned about the bolt and between the cone bottom end 30 and the lower end of the lower connecting pipe section 15'. This lower sleeve section is provided with gripping means 32 about the split sections to engage with the surface of the bore hole, as clearly described in my earlier patents referred to herein. Accordingly, the operation of the anchor bolt assembly need not be described in detail and suffice it only to state that, as the bolt is axially displaced outwardly by the pulling force exerted thereon by threading the nut 29, the conical bottom end of the bolt moves into the slotted bottom section of the lower sleeve section 31 causing the slotted wall sections to be displaced outwardly applying gripping pressure against the side wall of the bore hole 25. Because the anchor bolt assembly is disposed at an outwardly diverging angle, it can be seen that the anchors in the ground surface form a cone configuration about the pole, anchoring the pole further away from its circumference and thus providing larger resistance against overturning moments, Because of this layer anchoring strength, the bore holes need not be made very deep and may extend about 2-feet below the ground surface.

In order to facilitate the drilling of these angulated bore holes at substantially precise locations about the position where the vertical pole is to be anchored, there is provided a drilling template, shown in FIGS. 4A to 4C in FIG. 5. The drilling template 40 is comprised of a central connecting member 41 having three or more support arms 42 disposed at substantially equal angular spacing about the connecting member 41. A drill bit angularly extending guide tube 43 is secured to each free end of the support arms 42 and disposed at an angle corresponding to the angle of the anchor bolt connecting pipe 15, herein about 4° from the vertical. The arms 42 are telescopic support arms for adjusting the position of the guide tubes 43 along a common circle dependent on the size of the bolt to be anchored.

FIGS. 4A to 4C show central connecting members 41, 41' and 41" of different sizes and configuration, and these may be constituted by a flat metal plate which may be provided with a hole 44 at the center thereof to receive a pin to hold the template at a stationary position in the ground surface. The central connecting member can also act as a foot-pad to maintain the template in position during drilling. The telescopic arms are provided with fastenting screws 45 to secure them at the proper lengths so that all of the guide tubes 43 lie on the circumference of a common circle about the pole position.

As shown in FIG. 1, because the anchor bolt connecting pipe 15 is positioned spaced from the pole 12, the anchor bolt tightening nut 29 is also spaced from the pole making it easier to insert a wrench to turn the bolt and activate the anchor. This spacing of the connecting pipe 15 relative to the pole also provides increased anchoring strength. Because the bore holes do not extend as deep into the hard ground surface 13 due to their cone configuration, this results in the use of less material for the construction of the anchor bolt assembly as well as the anchor bolt connecting pipe, and yet providing increased connecting strength as the sloping anchor bolts provide stronger bracing than vertically extending anchor bolts. Also, because of the use of a universal size pole anchoring device, there is utilized a standard drill size bit to bore the holes in the ground as well as a standard size guide tube assembly 43 connecting to the arms 42 of templates 41. Smaller drill sizes also means faster drilling and less power requirements. The use of a common pole anchoring device also translates into cost savings for the users, as the product can be bought in bulk and there is a substantial reduction in inventory and handling.

It is within the ambit of the present invention to cover any other obvious modifications, provided such modifications fall within the scope of the appended claims.

I claim:

1. A universal pole anchoring device for supporting utility poles vertically over a hard surface such as rock, concrete or the like, said device being comprised in a harness assembly adapted to be connected about a base section of a pole to be supported on said hard surface, connecting means to immovably secure said harness assembly about said base section, said harness assembly being comprised of anchoring devices each defined by an anchor bolt guide pipe having a pair of pole engaging clamps connected thereto in spaced alignment, said pole engaging clamps being adapted to be attached to a pole, said pair of pole engaging clamps each having a web portion supporting said guide pipe and attaching said guide pipe to said pair of pole engaging clamps, each said web portion having a length, one of said web portions having a length greater than the length of the other of said web portions such that said guide pipe is supported at an angle greater than 0 and less than 90 degrees with respect to the pole engaging clamps, said harness assembly having a predetermined number of anchoring devices interconnected by said connected means about said base section depending on the diameter of said pole, and an anchor bolt assembly connectable to each said anchor bolt guide pipe of said harness members to anchor said harness assembly of said hard surface to support said pole vertically thereover.

2. A universal pole anchoring device as claimed in claim 1 wherein a first one of said pole engaging clamps is connected to a top end region of said pipe, a second one of said pole engaging clamps being connected to said pipe spaced below said first clamp, said pipe having a lower extension section for positioning into an anchoring hole in said hard surface.

3. A universal pole anchoring device as claimed in claim 2 wherein said clamps are elongated metal plates having a curved wall section with opposed connecting flanges, and connecting spacer means for securing said plates a predetermined distance from said connecting pipe, said first clamp plate being positioned closer to said pipe than said second clamp plate.

4. A universal pole anchoring device as claimed in claim 3 wherein said connecting spacer means is a transverse connecting plate secured transversely at mid-length of a convex outer surface of said curved wall section, said connecting plate having an outer sloped connecting edge secured to said pipe.

5. A universal pole anchoring device as claimed in claim 4 wherein said outer sloped connecting edge is welded to said pipe and supports said pipe at an angle of about 4° from a vertical axis of a pole supported by said harness assembly.

6. A universal pole anchoring device as claimed in claim 3 wherein a top free end of said pipe constitutes an abutment means for a threaded nut secured to a threaded top end section of said anchor bolt, a bottom free end of said pipe being in abutment with a lower sleeve section of said anchor bolt assembly and forming an isolation joint therewith.

7. A universal pole anchoring device as claimed in claim 6 wherein said lower sleeve section has a bottom expansion slitted wall, said anchor bolt having a conical bottom end, said expansion wall being supported about said anchor bolt over a top end section of said conical bottom end, said expansion slitted wall having outer gripping means to grip a side wall of a bore hole made in said hard surface when said bolt is axially displaced outwardly by a pulling force exerted thereon thereby causing said conical bottom end to apply lateral gripping pressure against said side wall of said bore hole.

8. A universal pole anchoring device as claimed in claim 3 wherein said clamps and associated connecting pipe are made of galvanized steel.

9. A universal pole anchoring device as claimed in claim 3 wherein said connecting means are connecting bolts interconnecting adjacent flanges of adjacent clamps to one another all around a post to be supported by said harness assembly.

10. A universal pole anchoring device comprising a harness assembly connectable about a base section of a utility pole to be supported vertically over a hard ground surface, such as rock, concrete or the like, said harness assembly being connected to anchor bolts to secure said anchor bolts to said hard ground surface, said harness assembly having at least three anchor bolt guide pipes, each guide pipe having a pair of pole engaging clamps connected thereto in spaced alignment; said pair of clamps being adapted to be attached to a pole whereby said harness assembly surrounds said pole, said pair of clamps being secured to said guide pipes by web portions of different lengths whereby said pipes extend between 0 and 90 degrees with respect to said pole, said anchor bolts being connected to each said guide pipe and extending in said hard ground surface in a cone-shaped configuration about said pole.

11. A universal pole anchoring device as claimed in claim 10 wherein a first one of said pole engaging clamps is connected to a top end region of said pipe, a second one of said pole engaging clamps being connected to said pipe spaced below said first clamp, said pipe having a lower extension section for positioning into an anchoring hole in said hard surface.

12. A universal pole anchoring device as claimed in claim 11 wherein said clamps are elongated metal plates having a curved wall section with opposed connecting flanges, and connecting spacer means for securing said plates a predetermined distance from said connecting pipe, said first clamp plate being positioned closer to said pipe than said second clamp plate.

13. A universal pole anchoring device as claimed in claim 12 wherein said connecting spacer means is a transverse connecting plate secured transversely at mid-length of a convex outer surface of said curved wall section, said connecting plate having an outer sloped connecting edge secured to said pipe.

14. A universal pole anchoring device as claimed in claim 13 wherein said outer sloped connecting edge is welded to said pipe and supports said pipe at an angle of about 4° from a vertical axis of a pole supported by said harness assembly.

15. A universal pole anchoring device as claimed in claim 12 wherein said clamps and associated connecting pipe are made of galvanized steel.

16. A universal pole anchoring device comprising a harness assembly connectable about a base section of a utility pole to be supported vertically over a hard ground surface, said harness assembly having at least three anchor bolt receiving guide means, each having a bolt passage defined between a top end and a bottom end of said guide means, said harness assembly having pole engaging clamps connected thereto in spaced alignment; said clamps being adapted to be interconnected about said base section of said utility pole whereby said harness assembly surrounds said pole when connected thereto, said bolt receiving guide means being spaced from and at an outwardly dependent angle to said pole whereby said anchor bolts extends at an angle greater than 0 and less than 90 degrees with respect to said pole, said anchor bolts being connected to said guide means and extend through said bolt passages from said bottom end and into said hard ground surface in a cone-shaped configuration about said pole, and securing means connected to a top end of said bolt which extends from said top end of said bolt passage to provide axial displacement and securement of said anchor bolts in hard ground.

17. A universal pole anchoring device as claimed in claim 16 wherein said guide mans is an elongated pipe, there being a pair of said clamps connected to said pipe by webs of different lengths.

* * * * *